US007950111B2

(12) United States Patent
Katnik

(10) Patent No.: US 7,950,111 B2
(45) Date of Patent: May 31, 2011

(54) APPARATUS FOR ATTACHING BOUTONNIERES

(75) Inventor: Vickie Ann Katnik, North Tustin, CA (US)

(73) Assignee: Vickie Ann Katnik, North Tustin, CA (US)

( * ) Notice: Subject to any disclaimer, the term of this patent is extended or adjusted under 35 U.S.C. 154(b) by 715 days.

(21) Appl. No.: 12/019,021

(22) Filed: Jan. 24, 2008

(65) Prior Publication Data

US 2009/0188084 A1 Jul. 30, 2009

Related U.S. Application Data

(60) Provisional application No. 60/888,050, filed on Feb. 2, 2007.

(51) Int. Cl.
*A44B 9/00* (2006.01)

(52) U.S. Cl. ..... 24/6; 24/706.2

(58) Field of Classification Search ..... None
See application file for complete search history.

(56) References Cited

U.S. PATENT DOCUMENTS 3,735,447 A * 5/1973 Abraham ..... 24/6
4,559,675 A * 12/1985 Devenny ..... 24/5
D334,905 S * 4/1993 Ritz ..... D11/43
D550,121 S 9/2007 Minneci

* cited by examiner

*Primary Examiner* — Jack W. Lavinder
(74) *Attorney, Agent, or Firm* — Snell & Wilmer L.L.P.

(57) ABSTRACT

The present invention relates to an apparatus for attaching boutonnieres. In one embodiment, the present invention is an apparatus for attaching a boutonniere including a first device, the first device including a first support structure, a first securing mechanism attached to the first support structure, and a base connected to the first support structure for securing the boutonniere. The present invention also includes a second device, the second device including a second support structure, and a second securing mechanism attached to the second support structure. The second securing mechanism cooperates with the first securing mechanism to secure the first support structure and the second support structure to a piece of material.

31 Claims, 2 Drawing Sheets

APPARATUS FOR ATTACHING BOUTONNIERES

The present Application for Patent claims priority to U.S. Provisional Patent Application No. 60/888,050 entitled "APPARATUS FOR ATTACHING BOUTONNIERES," filed Feb. 2, 2007, and hereby expressly incorporated by reference herein.

BACKGROUND

1. Field

The present invention relates to an apparatus for attaching boutonnieres.

2. Related Art

When people attend formal events such as proms, business parties, or weddings, they often times have to wear a tuxedo, a suit, or other types of formal clothing. Wearing formal clothing sometimes includes wearing a boutonniere. However, wearing a boutonniere can be cumbersome because it can be difficult to attach the boutonniere properly. When attaching the boutonniere, oftentimes, the user will use a pin. This usually requires the assistance of another person. Without being precise, the user can accidentally be stabbed by the pin, resulting in an unpleasant experience. This potential for the pin to stab the user does not cease with the final placement of the pin since the pin will usually be exposed after final placement. Furthermore, improper placement of the pin may result in the boutonniere moving to an undesired position or falling off the clothing. Thus, there is a need for a safe and effective apparatus for self-attaching boutonnieres.

SUMMARY

In one embodiment, the present invention is an apparatus for attaching a boutonniere including a first device, the first device including a first support structure, a first securing mechanism attached to the first support structure, and a base connected to the first support structure for securing the boutonniere. The present invention also includes a second device, the second device including a second support structure, and a second securing mechanism attached to the second support structure. The second securing mechanism cooperates with the first securing mechanism to secure the first support structure and the second support structure to a piece of material.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

Methods and apparatus that implement the embodiments of the various features of the present invention will now be described with reference to the drawings. The drawings and the associated descriptions are provided to illustrate embodiments of the present invention and not to limit the scope of the present invention. Reference in the specification to "one embodiment" or "an embodiment" is intended to indicate that a particular feature, structure, or characteristic described in connection with the embodiment is included in at least an embodiment of the present invention. The appearances of the phrase "in one embodiment" or "an embodiment" in various places in the specification are not necessarily all referring to the same embodiment. Throughout the drawings, reference numbers are re-used to indicate correspondence between referenced elements. In addition, the first digit of each reference number indicates the figure in which the element first appears.

Figure 1:
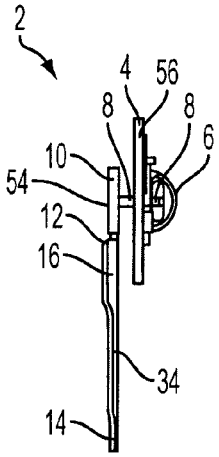
FIG. 1 is a side view of an apparatus for attaching boutonnieres according to an embodiment of the present invention.
Figure 2:
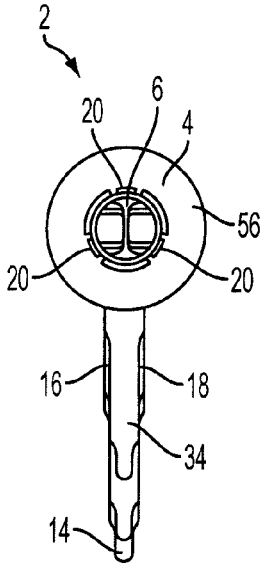
FIG. 2 is a front view of the apparatus for attaching boutonnieres of FIG. 1 according to an embodiment of the present invention.
Figure 3:
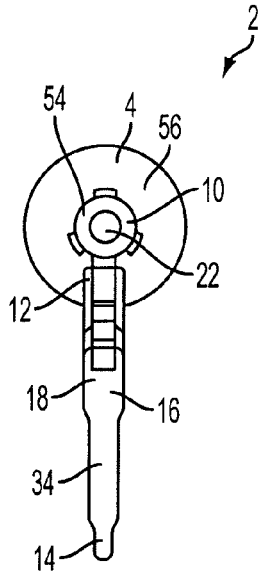
FIG. 3 is a rear view of the apparatus for attaching boutonnieres of FIG. 1 according to an embodiment of the present invention.
Figure 4:
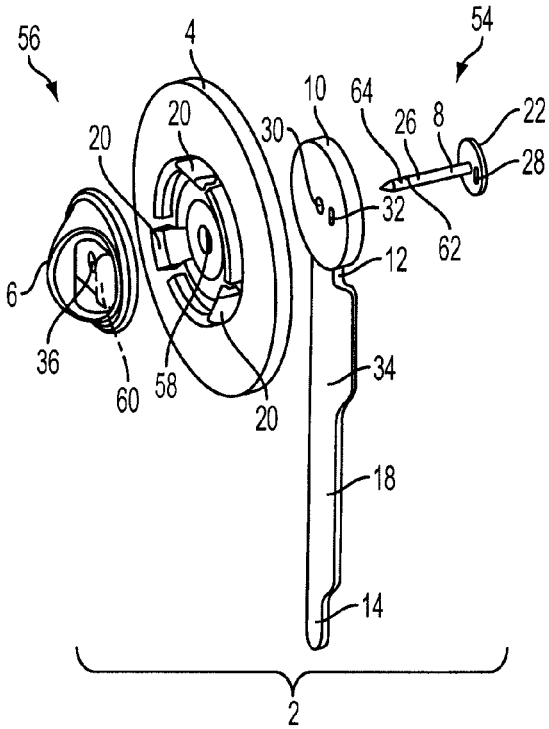
FIG. 4 is an exploded perspective view of the apparatus for attaching boutonnieres of FIG. 1 according to an embodiment of the present invention.

FIGS. 1-4 show an apparatus 2 for attaching a boutonniere to an article of clothing. The apparatus 2 includes a first device 54 and a second device 56. First device 54 includes a first support structure 10, a base 34 connected to the first support structure 10, and a pin 8 connected to the first support structure 10. First support structure 10 includes a first hole 30 and a second hole 32. Base 34 includes a first end 12, a second end 14, a first side 16, and a second side 18. As shown in FIGS. 2 and 4, base 34 is tapered from a portion near first end 12 to a portion near second end 14. As shown in FIGS. 1 and 4, base 34 is curved from first side 16 to second side 18. In one embodiment, base 34 is less than 2 inches in length, such as approximately 1.5 inches or approximately 1.35 inches. If, however, base 34 is too long, it is contemplated that portions of second end 14 can be removed such as with a scissor, blade, or device suitable for removal. Thus, the length of base 34 can be customized by a user.

Figure 5:
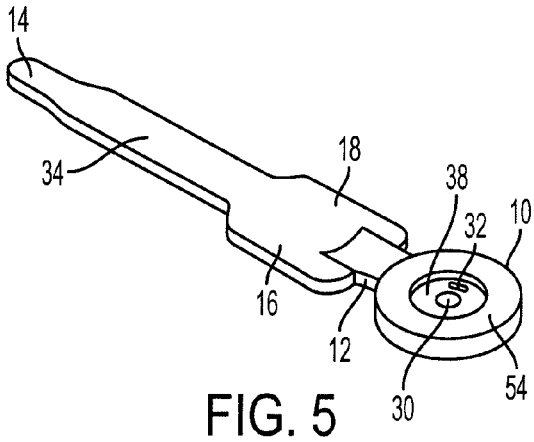
FIG. 5 is a perspective view of a first device of the apparatus for attaching boutonnieres according to an embodiment of the present invention.

FIG. 5 is a perspective view of first device 54 of apparatus 2. Base 34 is tapered from a portion near first end 12 to a portion near second end 14 and curved inward (i.e., concave) from first side 16 to second side 18. The boutonniere stem can fit in the curved base 34 and a piece of tape can be wrapped around the boutonniere stem and the base 34 to secure the boutonniere stem to the base 34. Furthermore, first support structure 10 may include a depression 38 with first hole 30 and second hole 32 in the depression 38. In one embodiment, first support structure 10 may be circular with a diameter of 1 inch or less, such as approximately 0.5 inches or approximately 0.4 inches.

Referring to FIGS. 4 and 5, pin 8 includes a lance 26, a backing 22, and an extended portion 28. Pin 8 can be secured to first support structure 10 by extended portion 28 cooperating with or fitting into second hole 32. Lance 26 fits through first hole 30 while backing 22 fits into depression 38. Lance 26 can optionally also have a first notch 62 and a second notch 64. It is contemplated that first notch 62 can be located less than 0.25 inches from backing 22 such as at approximately 0.240 inches from backing 22. It is also contemplated that second notch 64 can be located less than 0.3 inches from backing 22 such as at approximately 0.280 inches from backing 22. It is understood that the location of first notch 62 and second notch 64 can be varied along lance 26 according to the purpose, fabric, and/or clothing that apparatus 2 will be used for and is not limited to any specific or general locations indicated.

Thus, pin 8 can be securely attached to first support structure 10 using adhesive and extended portion 28 fitting into second hole 32 to substantially prevent rotation of pin 8. Pin 8 can be securely attached to first support structure 10 through other means such as through tape, Velcro, or any other securing mechanism by itself or in combination of each other. In one embodiment, lance 26 is less than 0.5 inches in length, such as approximately 0.375 inches.

Referring to FIGS. 1-4, second device 56 includes a second support structure 4 and a clasp 6. Second support structure 4 includes raised clips 20 and a first hole 58. Raised clips 20 can secure clasp 6 to second support structure 4. Adhesive can also be used in addition to or in place of raised clips 20. Other securing mechanisms can be used in addition to or in place of raised clips 20 to secure clasp 6 to second support structure 4. In one embodiment, second support structure 4 is substantially circular and has a diameter of less than 2 inches, such as approximately 1.5 inches, or 1 inch. Also, a logo can optionally be imprinted on second support structure 4.

Clasp 6 includes wings 60 and a first hole 36. In one embodiment, when wings 60 are depressed, an object (e.g., pin 8 or lance 26) is permitted to enter first hole 36. When wings 60 are released, an object is not permitted to enter first hole 36 if it is not already in first hole 36. However, if an object is already in first hole 36, wings 60 releasably secure the object in first hole 36. Clasp 6 can also shield the object to prevent accidental contact with the object.

Lance 26 from pin 8 can enter through first hole 58 and be secured by wings 60 of clasp 6, thus securing first support structure 10 to second support structure 4. First notch 62 and/or second notch 64 could substantially reduce the vertical movement of lance 26 and aid in securing pin 8 to clasp 6. Clasp 6 can also shield lance 26 to prevent any accidental contact with lance 26 to protect the integrity of lance 26 and also prevent injury to any objects or people who may accidentally contact lance 26.

Figure 6:
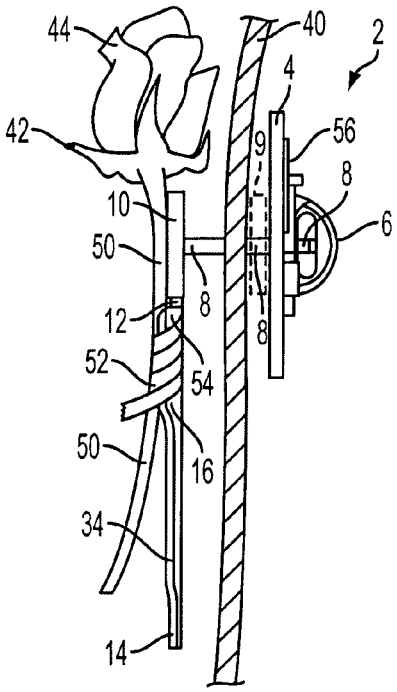
FIG. 6 is a side view of the apparatus of FIG. 1 attached to an article of clothing and a boutonniere according to an embodiment of the present invention.

FIG. 6 is a side view of the apparatus 2 of FIG. 1 attached to an article of clothing 40 and a boutonniere 42. Boutonniere 42 may be a flower with a head 44 and a stem 50. It is contemplated that the flower could be a small flower. Boutonniere 42 is secured to first device 54 by wrapping floral tape 52 around base 34 and stem 50. Pin 8 can penetrate fabric 40 to secure first device 54 to second device 56. In doing so, pin 8 can also secure first device 54 and second device 56 to fabric 40. An optional foam piece 9 can be positioned around pin 8 to reduce the movement of boutonniere 42. Since boutonniere 42 is attached to first device 54, boutonniere 42 is also substantially secured to fabric 40. Fabric 40 can be, for example, a tuxedo, a suit, a jacket, or any other type of clothing or material.

Since flowers tend to have larger stems near head 44, it is contemplated that by tapering base 34 from a portion near first end 12 to second end 14 such that the portion near first end 12 is larger than the portion near second end 14, apparatus 2 can provide adequate support for boutonniere 42 near first end 12 but reduce the overall size, weight, and material used in apparatus 2. The tapered base 34 also results in less visibility of apparatus 2 which can be aesthetically pleasing. Furthermore, less material can also mean less production costs and also less weight. A reduced weight of apparatus 2 increases the comfort felt by a user of apparatus 2.

Furthermore, when base 34 is curved from first portion 16 to second portion 18, base 34 cradles stem 50 of boutonniere 42. The curved base 34 increases the security of boutonniere 42 to base 34 and first device 54 and substantially prevents boutonniere 42 from slipping or moving around.

Although pin 8 and clasp 6 are used to secure first device 54 to second device 56, any other type of securing mechanism can be used to secure first device 54 to second device 56 including, but not limited to, magnets, safety pins, clamps, etc. Also, although floral tape 52 is used to secure boutonniere 42 to base 34, any other securing mechanism can work such as clear tape, glue, string, various adhesives, wire, etc.

Figure 7:
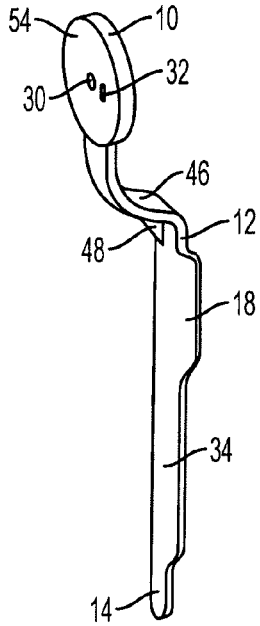
FIGS. 7 and 8 are perspective views of an alternate embodiment of first device of apparatus according to an embodiment of the present invention.
Figure 8:
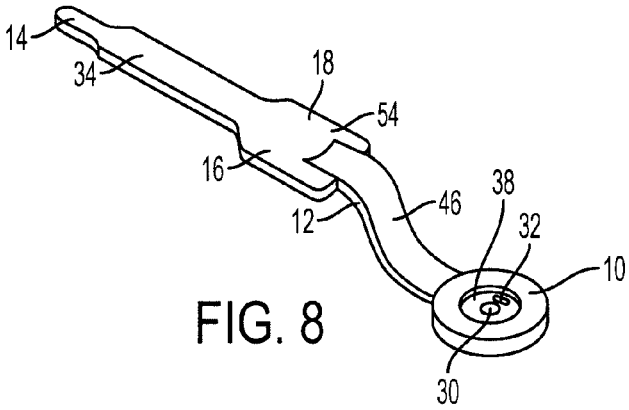

FIGS. 7 and 8 are perspective views of an alternate embodiment of first device 54 of apparatus 2. Notably, first device 54 includes a curved connector or neck 46 between first support structure 10 and base 34. Curved neck 46 increases the distance between first support structure 10 and base 34. Curved neck 46 also allows for a better fit between boutonniere 42 and first support structure 10 since head 44 is usually larger than stem 50. Also, curved neck 46 in FIGS. 7 and 8 could also allow for a larger boutonniere 42 with a larger head 44 than the boutonniere 42 in FIGS. 1-6. For example, curved neck 46 in FIGS. 7 and 8 could allow for a standard sized rose as opposed to a small sized rose in FIGS. 1-6 to be used.

Furthermore, curved neck 46 allows the head 44 of the boutonniere 42 to maintain an upright position and prevents the head 44 from tilting over due to first support structure 10. Hence, stem 50 may be supported by base 34 while head 44 may be supported by first support structure 10 and/or curved neck 46. Triangular support element 48 can connect curved neck 46 and base 34 to provide support for curved neck 46. In one embodiment, first support structure 10 and base 34 are less than 1.25 inches apart, such as approximately 1.125 inches apart.

Figure 9:
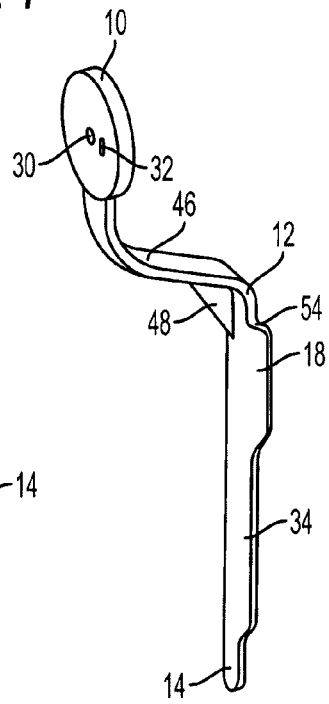
FIGS. 9 and 10 are perspective views of an alternate embodiment of first device of apparatus according to an embodiment of the present invention.
Figure 10:
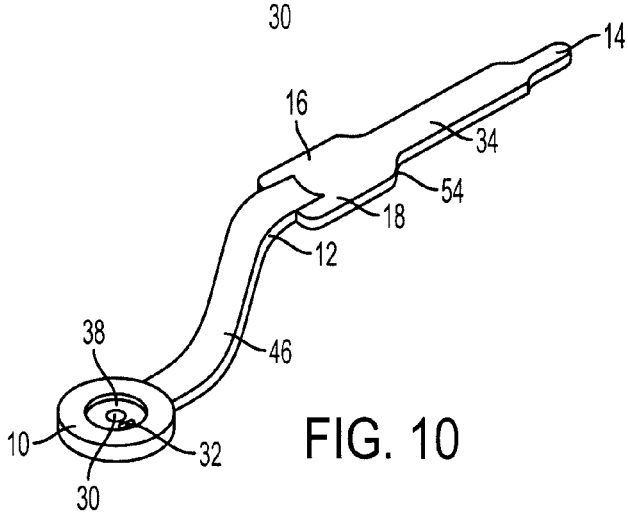

FIGS. 9 and 10 are perspective views of an alternate embodiment of first device 54 of apparatus 2. Like FIGS. 7 and 8, this embodiment includes a curved neck 46 between first support structure 10 and base 34. However, curved neck 46 in FIGS. 9 and 10 is longer than curved neck 46 in FIGS. 7 and 8. Curved neck 46 provides a greater distance between first support structure 10 and base 34 allowing for a boutonniere 42 with a larger head 50 to be secured to first device 54. Triangular support element 48 can connect curved neck 46 and base 34 to provide support for curved neck 46. In one embodiment, first support structure 10 and base 34 are less than 1.50 inch apart, such as approximately 1.25 inches apart, or 1.0 inches apart.

Apparatus 2 can be made of a material such as plastic, metal, alloy, or any or any combination of plastic, metal, or alloy. Apparatus 2 can be made of other durable lightweight material which can be used to secure a boutonniere to a material.

Furthermore, curved neck 46 in FIGS. 9 and 10 could also allow for a larger boutonniere 42 with a larger head 44 than the boutonniere 42 in FIGS. 1-8. For example, curved neck 46 in FIGS. 9 and 10 could allow for a large sized rose as opposed to a small or standard sized rose in FIGS. 1-8 to be used.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the present invention is, therefore, indicated by the appended claims rather than by the foregoing description. All changes which come within the meaning and range of equivalency of the claims are to be embraced within their scope.

What is claimed is:

1. An apparatus for attaching a boutonniere comprising:
a first device including:
a first support structure,
a first securing mechanism attached to the first support structure, the first securing mechanism is a pin, and
a base connected to the first support structure for securing the boutonniere; and
a second device including:
a second support structure, and
a second securing mechanism attached to the second support structure, the second securing mechanism removably attachable to the first securing mechanism for securing the first support structure to the second support structure at no more than one location.

2. The apparatus of claim 1 wherein the second securing mechanism is a clasp.

3. The apparatus of claim 2 wherein the second support structure includes a raised clip to attach the clasp to the second support structure.

4. The apparatus of claim 1 wherein
the first support structure further includes a portion defining a hole, and
the pin further includes a backing with an extended portion, the extended portion cooperating with the hole to attach the pin to the first support structure.

5. The apparatus of claim 1 further comprising a curved neck connecting the base to the first support structure.

6. The apparatus of claim 5 further comprising a triangular support element connected to the curved neck and the first support structure.

7. The apparatus of claim 1 wherein the base includes a first end and a second end, the base connected to the first support structure at the first end, the base further including a first side and a second side, the first side and the second side each extending from the first end to the second end, wherein the base is curved from the first side to the second side.

8. The apparatus of claim 7 wherein the base is tapered from a portion adjacent the first end to the second end.

9. An apparatus for attaching a boutonniere comprising:
a first device including:
a first support structure including a portion defining a hole,
a pin including a backing with an extended portion, the extended portion cooperating with the hole to attach the pin to the first support structure, and
a base connected to the first support structure for securing the boutonniere; and
a second device including:
a second support structure, and
a clasp attached to the second support structure, the clasp cooperating with the pin to secure the first support structure to the second support structure.

10. The apparatus of claim 9 wherein the second support structure includes a raised clip to attach the clasp to the second support structure.

11. The apparatus of claim 9 further comprising a curved neck connecting the base to the first support structure.

12. The apparatus of claim 11 further comprising a triangular support element connected to the curved neck and the first support structure.

13. The apparatus of claim 9 wherein the base includes a first end and a second end, the base connected to the first support structure at the first end, the base further including a first side and a second side, the first side and the second side each extending from the first end to the second end, wherein the base is curved from the first side to the second side.

14. The apparatus of claim 9 wherein the base is tapered from a portion adjacent the first end to the second end.

15. An apparatus for attaching a boutonniere comprising:
a first device including:
a first support structure,
a pin attached to the first support structure,
a curved neck connected to the first support structure, and
a base connected to the curved neck for securing the boutonniere; and
a second device including:
a second support structure, and
a clasp attached to the second support structure, the clasp cooperating with the pin to secure the first support structure and the second support structure to a piece of material.

16. The apparatus of claim 15 wherein
the first support structure further includes a portion defining a hole,
the pin further includes a backing with an extended portion, the extended portion cooperating with the hole to attach the pin to the first support structure, and
the second support structure includes a raised clip to attach the clasp to the first support structure.

17. The apparatus of claim 15 further comprising a triangular support element connected to the curved neck and the first support structure.

18. The apparatus of claim 15 wherein the base includes a first end and a second end, the base connected to the first support structure at the first end, the base further including a first side and a second side, the first side and the second side each extending from the first end to the second end, wherein the base is curved from the first side to the second side.

19. The apparatus of claim 15 wherein the base is tapered from a portion adjacent the first end to the second end.

20. An apparatus for attaching a boutonniere comprising:
a first device including:
a first support structure,
a pin attached to the first support structure, and
a base connected to the first support structure for securing the boutonniere; and
a second device including:
a second support structure including a raised clip, and
a clasp attached to the second support structure through use of the raised clip, the clasp cooperating with the pin to secure the first support structure to the second support structure.

21. The apparatus of claim 20 further comprising a curved neck connecting the base to the first support structure.

22. The apparatus of claim 21 further comprising a triangular support element connected to the curved neck and the first support structure.

23. The apparatus of claim 20 wherein the base includes a first end and a second end, the base connected to the first support structure at the first end, the base further including a first side and a second side, the first side and the second side each extending from the first end to the second end, wherein the base is curved from the first side to the second side.

24. The apparatus of claim 20 wherein the base is tapered from a portion adjacent the first end to the second end.

25. An apparatus for attaching a boutonniere comprising:
a first device including:
a first support structure, a first securing mechanism attached to the first support structure, a curved neck connected to the first support structure, and a base connected to the curved neck for securing the boutonniere; and a second device including:

a second support structure, and a second securing mechanism attached to the second support structure, the second securing mechanism cooperating with the first securing mechanism to secure the first support structure to the second support structure.

26. The apparatus of claim 25 wherein the first securing mechanism is a pin.

27. The apparatus of claim 25 wherein the second securing mechanism is a clasp.

28. The apparatus of claim 27 further comprising a triangular support element connected to the curved neck and the first support structure.

29. The apparatus of claim 25 further comprising a triangular support element connected to the curved neck and the first support structure.

30. The apparatus of claim 25 wherein the base includes a first end and a second end, the base connected to the first support structure at the first end, the base further including a first side and a second side, the first side and the second side each extending from the first end to the second end, wherein the base is curved from the first side to the second side.

31. The apparatus of claim 25 wherein the base is tapered from a portion adjacent the first end to the second end.

* * * * *